US010954033B2

(12) United States Patent
Kolecki et al.

(10) Patent No.: US 10,954,033 B2
(45) Date of Patent: Mar. 23, 2021

(54) FOLDABLE CRATE FOR A LAWN MAINTENANCE VEHICLE

(71) Applicant: MTD PRODUCTS INC, Valley City, OH (US)

(72) Inventors: Jason Kolecki, Medina, OH (US); Michael D. Menke, Medina, OH (US)

(73) Assignee: MTD PRODUCTS INC, Valley City, OH (US)

( * ) Notice: Subject to any disclaimer, the term of this patent is extended or adjusted under 35 U.S.C. 154(b) by 0 days.

(21) Appl. No.: 16/142,204

(22) Filed: Sep. 26, 2018

(65) Prior Publication Data

US 2019/0100350 A1 Apr. 4, 2019

Related U.S. Application Data

(60) Provisional application No. 62/565,409, filed on Sep. 29, 2017.

(51) Int. Cl.
*B65D 19/06* (2006.01)
*B65D 85/68* (2006.01)
(Continued)

(52) U.S. Cl.
CPC ..... *B65D 19/06* (2013.01); *B65D 19/12* (2013.01); *B65D 19/385* (2013.01); *B65D 85/68* (2013.01);
(Continued)

(58) Field of Classification Search
CPC ..... B65D 19/06; B65D 19/385; B65D 2519/00024; B65D 2519/00044; B65D 2519/00059; B65D 2519/00079; B65D 2519/00164; B65D 2519/00184; B65D 2519/00333; B65D 2519/0082;
(Continued)

(56) References Cited

U.S. PATENT DOCUMENTS 2,686,645 A * 8/1954 Whitehurst ..... B65D 19/385 108/53.5
2,699,911 A * 1/1955 Chase ..... B65D 19/385 108/53.5
(Continued)

FOREIGN PATENT DOCUMENTS

| | | |
|---|---|---|
| DE | 20116389 | 2/2002 |
| DE | 202006002630 | 5/2006 |
| EP | 1052193 | 11/2000 |

OTHER PUBLICATIONS

International Search Report and Written Opinion for corresponding International Patent Application No. PCT/US2018/053020 dated Nov. 16, 2018.

*Primary Examiner* — Daniel J Troy
*Assistant Examiner* — Timothy M Ayres
(74) *Attorney, Agent, or Firm* — Wegman Hessler

(57) ABSTRACT

A foldable crate includes a base having a front end and a rear end and a pair of end gates, wherein an end gate is rotatably attached to each end of the base. Each end gate includes a cap attached adjacent to one end of each post of the end gate and a knob is attached adjacent to the opposing end of each post. A skid shoe is attached to the bottom of each corner of the base, wherein each skid shoe includes a socket for receiving the knob or cap of the corresponding end gate of an adjacent foldable crate when a plurality of foldable crates are stacked.

17 Claims, 12 Drawing Sheets

(51) Int. Cl.
*B65D 19/12* (2006.01)
*B65D 19/38* (2006.01)

(52) U.S. Cl.
CPC ..... *B65D 2519/009* (2013.01); *B65D 2519/00024* (2013.01); *B65D 2519/00044* (2013.01); *B65D 2519/00059* (2013.01); *B65D 2519/00079* (2013.01); *B65D 2519/0082* (2013.01); *B65D 2519/0093* (2013.01); *B65D 2519/0096* (2013.01); *B65D 2519/0097* (2013.01); *B65D 2519/00164* (2013.01); *B65D 2519/00184* (2013.01); *B65D 2519/00233* (2013.01); *B65D 2519/00273* (2013.01); *B65D 2519/00293* (2013.01); *B65D 2519/00323* (2013.01); *B65D 2519/00333* (2013.01); *B65D 2519/00338* (2013.01); *B65D 2519/00502* (2013.01); *B65D 2519/00562* (2013.01); *B65D 2519/00631* (2013.01); *B65D 2519/00656* (2013.01); *B65D 2519/00661* (2013.01); *B65D 2519/00691* (2013.01); *B65D 2519/00696* (2013.01); *B65D 2519/00805* (2013.01); *B65D 2519/00815* (2013.01); *B65D 2519/00975* (2013.01); *B65D 2585/6872* (2013.01)

(58) Field of Classification Search
CPC ..... B65D 2519/009; B65D 2519/0093; B65D 2519/0096; B65D 2519/00975
USPC ..... 108/51.11, 53.1, 55.1–55.5
See application file for complete search history.

(56) References Cited

U.S. PATENT DOCUMENTS 2,781,936 A * 2/1957 Bitney ..... B65D 19/12 220/6
2,936,985 A * 5/1960 Doerr ..... B65D 19/08 108/55.1
2,956,763 A * 10/1960 D'Arca ..... B65D 19/12 108/53.1
RE26,481 E * 10/1968 Evans ..... B65D 19/385 108/53.5
3,620,388 A 11/1971 Mansson
3,865,250 A * 2/1975 Jay ..... B65D 19/12 211/194
3,867,997 A * 2/1975 Hyslop, Jr. ..... E04G 5/14 182/113
4,353,520 A * 10/1982 Jansson ..... B65D 88/129 108/55.1
4,553,484 A * 11/1985 Cox ..... B65D 19/06 108/55.1
4,804,087 A 2/1989 Smith
5,154,256 A * 10/1992 Wood ..... E04G 5/14 182/113
5,169,011 A * 12/1992 Ebeling ..... B65D 88/522 108/53.1
5,465,812 A * 11/1995 Petter ..... B65D 19/385 187/237
5,639,174 A 6/1997 Gonska
5,755,472 A * 5/1998 Clive-Smith ..... B65D 88/129 108/53.1
5,810,186 A * 9/1998 Lam ..... B65D 88/129 108/55.1
6,053,346 A 4/2000 Niles
6,279,763 B1 8/2001 Bush
6,325,224 B1 12/2001 Brown
6,513,442 B1 2/2003 Miller
6,585,126 B1 7/2003 Grigsby, Sr.
6,726,041 B2 * 4/2004 Dunn ..... B65D 19/12 206/335
6,866,160 B2 3/2005 Wang
7,011,223 B1 3/2006 Grigsby, Sr.
7,011,479 B2 3/2006 Sain
7,040,848 B2 5/2006 Sain
7,044,065 B2 * 5/2006 Arai ..... B65D 19/12 108/53.1
7,140,821 B2 11/2006 Sain
7,387,215 B1 6/2008 Grigsby, Sr.
7,491,024 B2 * 2/2009 Heinrichs ..... B65D 19/12 108/53.1
7,624,887 B2 12/2009 Avery
7,802,526 B2 * 9/2010 Brady ..... B65D 19/12 108/53.5
7,827,655 B2 11/2010 Yi
8,210,374 B2 7/2012 Harpole
8,286,562 B2 10/2012 Reynard
8,342,784 B2 1/2013 Crane
8,353,647 B2 1/2013 Crane
8,381,929 B2 2/2013 Kellerer
8,434,631 B2 5/2013 Harpole
8,453,861 B2 6/2013 Joubert
8,511,495 B2 8/2013 Grigsby
8,567,634 B2 10/2013 Huizingh
8,579,565 B2 11/2013 Fell
8,714,895 B2 5/2014 Crane
8,757,943 B2 6/2014 Crane
9,096,363 B2 8/2015 Reynard
9,156,607 B2 10/2015 Adams
9,540,139 B2 * 1/2017 Baltz ..... B65D 19/385
9,969,526 B1 * 5/2018 Lowther ..... B65D 19/44
10,029,820 B2 * 7/2018 Van Doorn ..... B65D 19/385
2005/0011791 A1 1/2005 Bartholomew
2009/0279976 A1 11/2009 Sain
2010/0135742 A1 6/2010 Sain
2010/0294785 A1 11/2010 Massa
2011/0073595 A1 3/2011 Crane
2013/0233811 A1 9/2013 Glover
2014/0231425 A1 8/2014 Jian
2015/0257530 A1 9/2015 Naka

* cited by examiner

FOLDABLE CRATE FOR A LAWN MAINTENANCE VEHICLE

CROSS-REFERENCE TO RELATED APPLICATION(S)

The present application claims the benefit of U.S. Patent Application No. 62/565,409, filed Sep. 29, 2017.

FIELD OF THE INVENTION

The present invention relates to shipping containers for shipping large items, and more particularly, to shipping crates for transporting a riding vehicle.

BACKGROUND OF THE INVENTION

Shipping crates, especially those used to transport riding vehicles such as riding lawn mowers, four-wheel all-terrain vehicles, and the like are often made of wood. These wood crates can either be disposable (one-use) or returnable (multi-use). Wood shipping crates tend to wear down or deteriorate quickly due to natural environmental degradation from water damage, mold, and repeated loading and unloading of heavy vehicles. When wood shipping crates end their end-of-life, customer complaints increase. The wood can also create potential rusting issues with the metal on the lawn maintenance vehicle that touches the wood. The production of the wood crates themselves depends upon the availability of hardwood used for the crates, which can vary.

The metal shipping crates used to transport riding vehicles are often bulky, heavy, and require extensive time and effort by the customer to disassemble the metal crate in order to remove the vehicle. The same time and effort is also required at the manufacturing facility necessary for packaging a riding vehicle. The metal crates are also often formed of tubular steel, which increases the overall weight as well as making it difficult to provide for access points for forks of a fork lift.

BRIEF SUMMARY OF THE INVENTION

In one aspect of the present invention, a foldable crate is provided. The foldable crate includes a base having a front end and a rear end. The base includes a frame formed by a plurality of longitudinal beams and a plurality of lateral beams connected to the plurality of longitudinal beams. The base also includes a plurality of skid shoes attached to a bottom of the frame. A first end gate is rotatably attached to the front end of the base and a second end gate rotatably attached to the rear end of the base. The first and second end gates are rotatable relative to the base between at least a first operative position, a second operative position and a third operative position. The first and second gates are independently rotatable relative to the base between a first operative position, a second operative position, and a third operative position.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
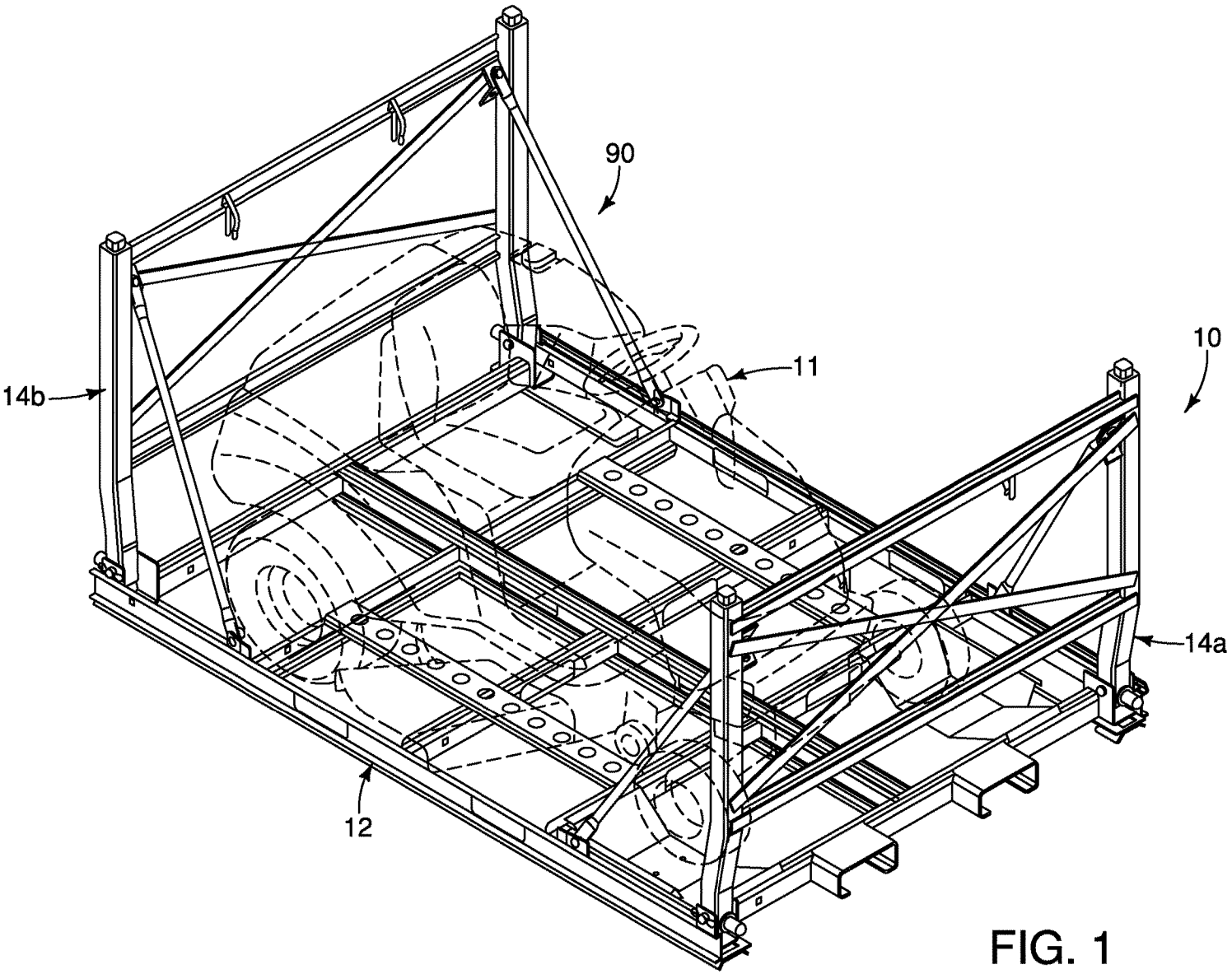
FIG. 1 is an isometric view of an embodiment of a foldable crate supporting a riding vehicle.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Figure 2:
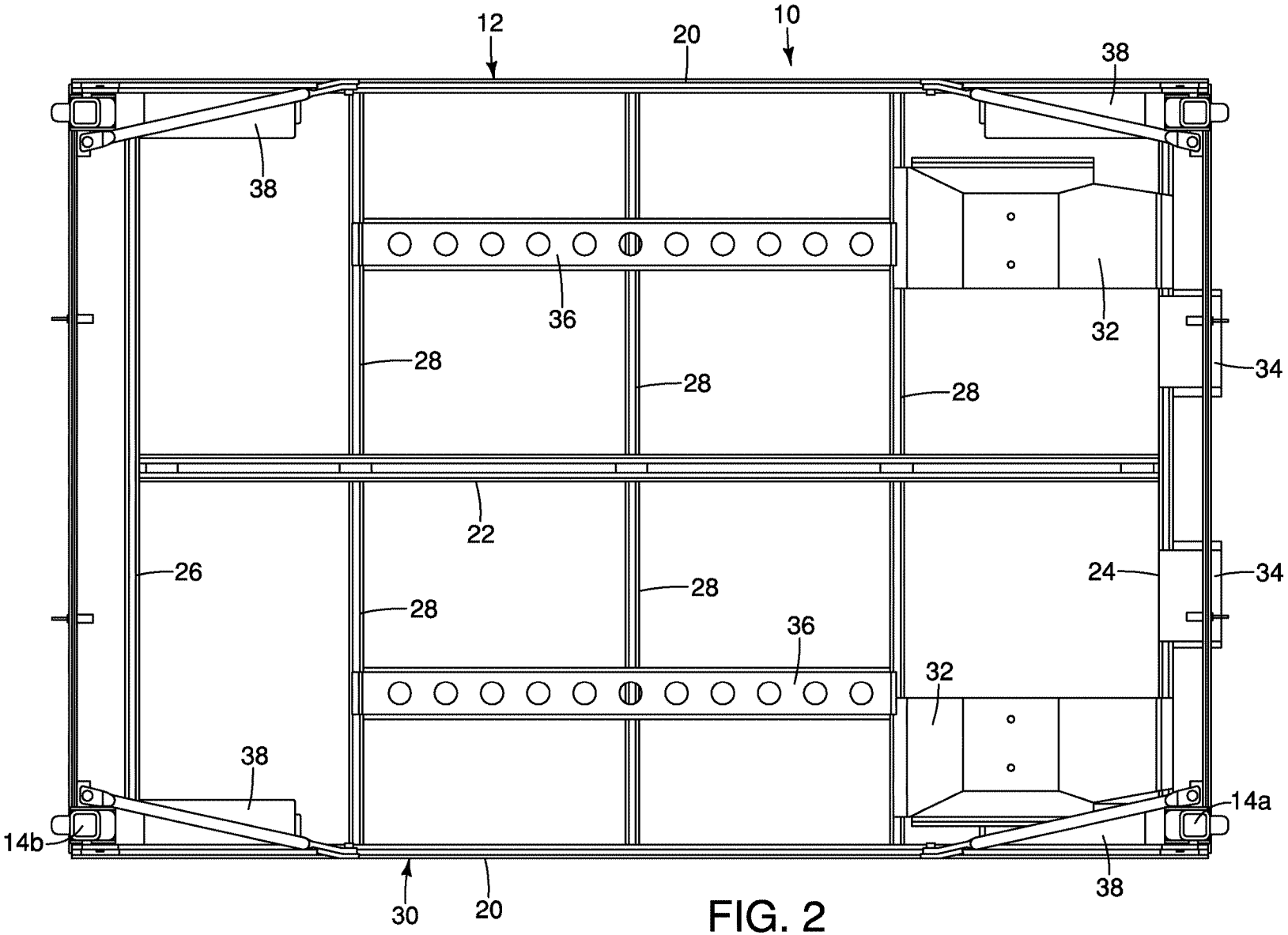
FIG. 2 is a top view of the foldable crate of FIG. 1 in a first operative position.
Figure 3:
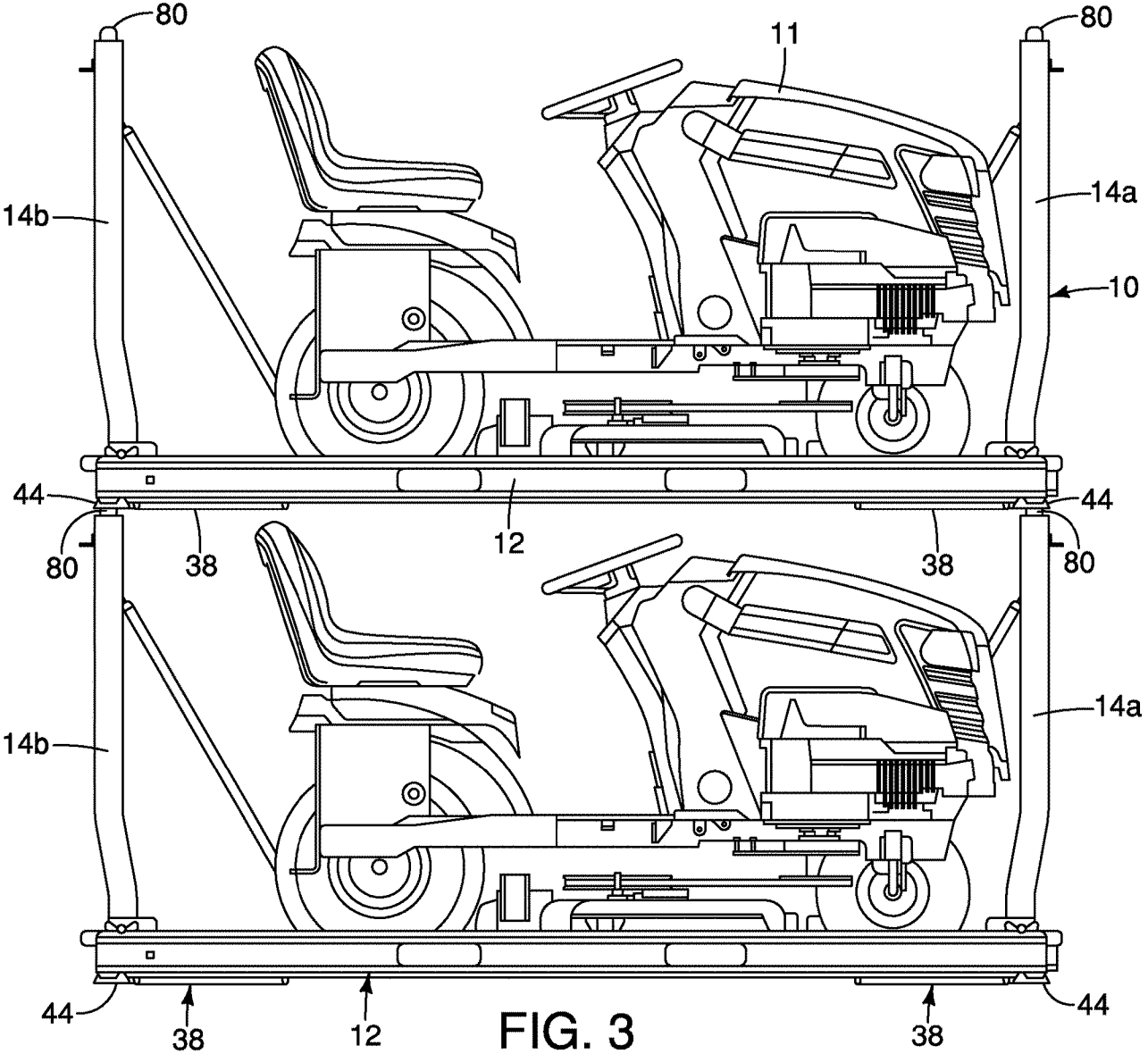
FIG. 3 is a side view of a plurality of stacked foldable crates of FIG. 1 in the first operative position.
Figure 4:
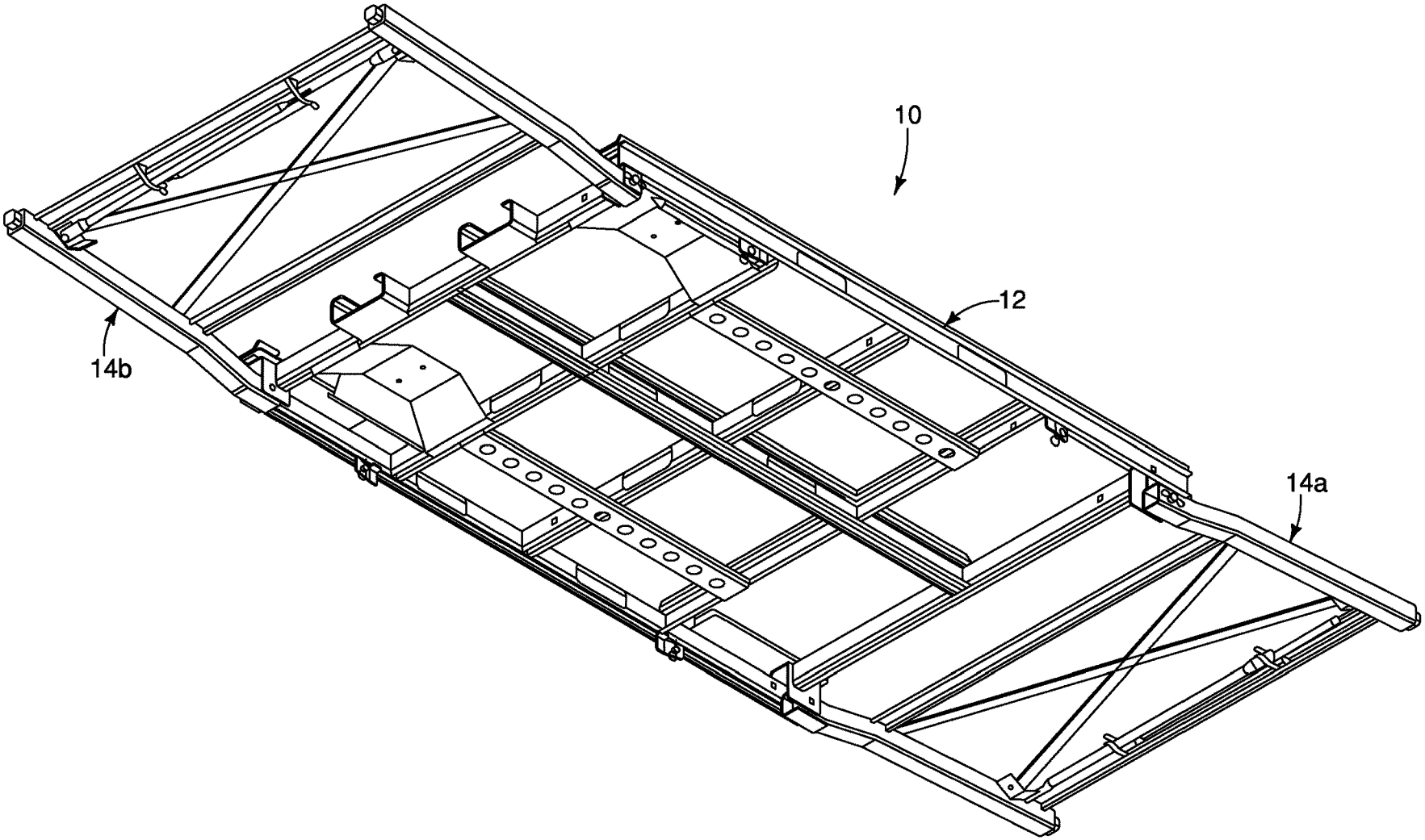
FIG. 4 is an isometric view of a foldable crate in a second operative position.
Figure 5:
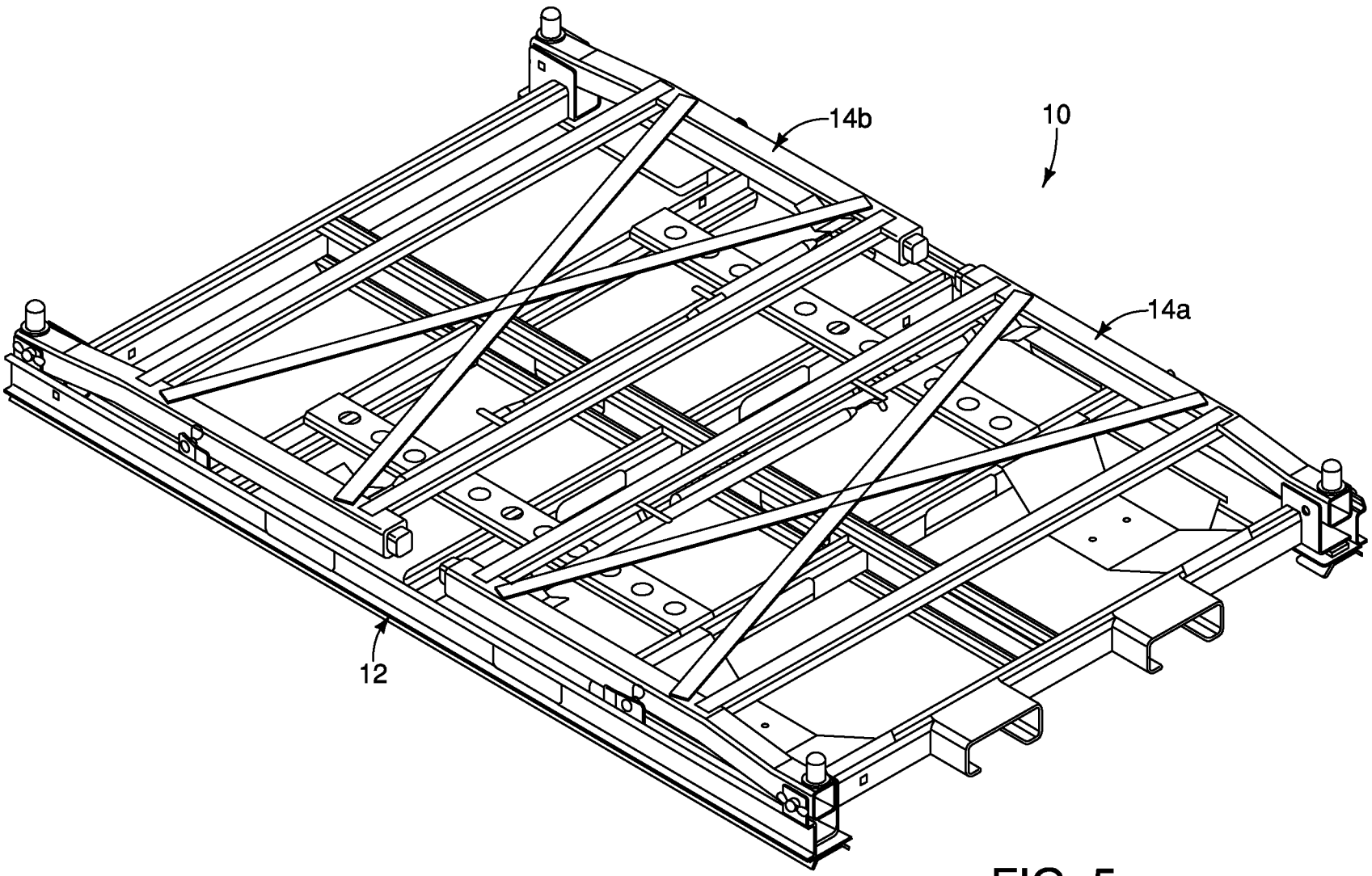
FIG. 5 is an isometric view of a foldable crate in a third operative position.

Referring to FIGS. 1-5, an exemplary embodiment of a foldable crate 10 for transporting a riding vehicle 11 is provided. Exemplary riding vehicles 11 include riding lawn mowers, four-wheel all-terrain vehicles, lawn tractors, stand-on law mowers, and the like. FIG. 1 illustrates a riding lawn mower stowed on the foldable crate 10. The foldable crate 10 includes a base 12, a first end gate 14*a*, and a second end gate 14*b*. The first end gate 14*a* is located at the front end of the crate 10, and the second end gate 14*b* is located at the rear end of the crate 10, wherein a longitudinal axis extending lengthwise between the first and second end gates 14*a*, 14*b*. The first and second end gates 14*a*, 14*b* are rotatable relative between a first operative position (FIGS. 1-3), a second operative position (FIG. 4), and a third operative position (FIG. 5) relative to the base 12. FIGS. 1-3 illustrate the foldable crate 10 in which both the first and second end gates 14*a*, 14*b* are in a first operative position—the transport position—in which both the first and second end gates 14*a*, 14*b* are rotated to a perpendicular orientation relative to the base 12. When the first and second end gates 14*a*, 14*b* are in the first operative position, the riding vehicle 11 is stowed and secured within the outer edges of the crate 10 for protection during transport. When the first and second end gates 14*a*, 14*b* are oriented in the first operative position, each of the first and second end gates 14*a*, 14*b* is operatively secured to the base 12 to prevent inward or outward rotation by way of a pair of diagonal braces 18. FIG. 4 illustrates the foldable crate 10 in which both the first and second end gates 14*a*, 14*b* are in a second operative position—the loading/unloading position—in which both the first and second end gates 14*a*, 14*b* are rotated downwardly relative to the base 12 until both end gates contact the ground and are in a fully opened position. In this second operative position, the first and second end gates 14*a*, 14*b* are oriented in a generally parallel manner relative to the base 12, wherein a portion of each gate is oriented in an offset, parallel manner relative to the frame 30 when the first and/or second gate is located in the second operative position. When the first and second end gates 14*a*, 14*b* are in the second operative position, a riding vehicle 11 can be loaded onto the crate 10 or offloaded from the crate 10. FIG. 5 illustrates the foldable crate 10 in which both the first and second end gates 14*a*, 14*b* are in a third operative position—the stacked position—in which both the first and second end gates 14*a*, 14*b* are rotated to a position in which the first and second end gates 14*a*, 14*b* are positioned immediately adjacent to the base 12 in a generally parallel orientation. When the first and second end gates 14*a*, 14*b* are in the third operative position, the crate 10 is folded into a compact size that allows multiple crates 10 to be easily stacked upon each other for ease of transporting multiple crates 10 at a time.

Figure 6:
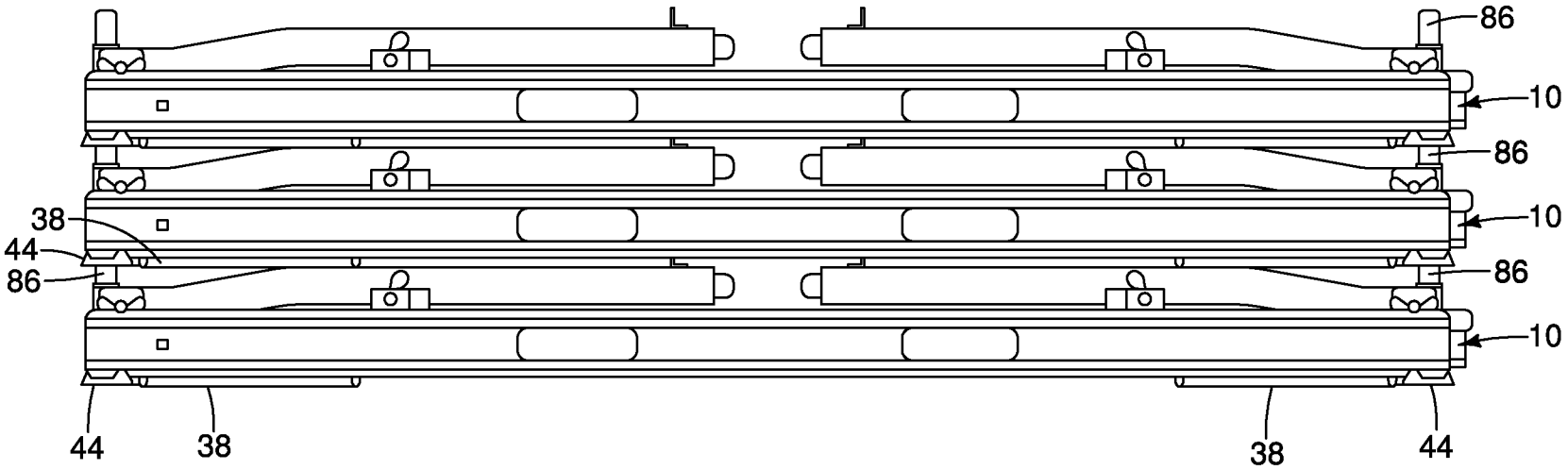
FIG. 6 is a side view of a plurality of stacked foldable crates of FIG. 1 in the third operative position.

FIG. 6 illustrates a plurality of foldable crates 10 in which the first and second end gates 14*a*, 14*b* are folded into the third operative position and the crates 10 stacked onto each other and ready to be transported. The first and second end gates 14*a*, 14*b* are freely and independently rotatable between the first, second, and third operative positions. The first and second end gates 14*a*, 14*b* are each independently rotatable relative to the base 12. When the first and second end gates 14*a*, 14*b* are positioned in the second and/or third operative positions, the end gates are only secured to the base 12 at the hinge assembly 17 but remain freely rotatable relative to the base 12. When the first and/or second end gate 14*a*, 14*b* is positioned in the first operative position, the end gate 14 is positively attached to the base 12 by way of the diagonal braces 18 which prevents rotation of the first and/or second end gate 14*a*, 14*b* relative to the base 12.

It should be understood by one having ordinary skill in the art that the first end gate 14*a* can be positioned in a different operative position than the second end gate 14*b* at the same time. For example, when loading a riding vehicle 11 onto the crate 10, the first end gate 14*a* can be positioned in the first operative position—in which it is raised and oriented at substantially perpendicular relative to the base 12—and the second end gate 14*b* is position in the second operative position—in which the second end gate 14*b* is contacting the ground and oriented generally parallel to the base 12.

In an exemplary embodiment, the base 12 includes a structural frame 30 formed of a plurality of structural components attached to each other to provide a structural support for the base 12. The frame 30 includes a plurality of longitudinal beams and a plurality of lateral beams that extend between adjacent longitudinal beams. In the embodiment illustrated in FIGS. 7-8, the frame 30 includes a pair of outer longitudinal beams 20, a central longitudinal beam 22, a front lateral beam 24 positioned adjacent to the front end of the frame 30, a rear lateral beam 26 positioned adjacent to the rear end of the frame 30, and a plurality of central lateral beams 28. It should be understood by one having ordinary skill in the art that the structural frame 30 can include any number of central longitudinal beams 22 and/or central lateral beams 28. The frame 30 forms a structural matrix defining the floor or base of the foldable crate 10 sufficient to support and transport a riding vehicle 11. The exemplary embodiment of the base 12 further includes a pair of front wheel pans 32, a pair of fork guides 34, and a pair of transfer rails 36 attached to a plurality of central lateral beams 28. The base 12 further includes a pair of front and rear skid shoes 38 fixedly attached to the bottom of the frame 30 adjacent to the front and rear ends of the frame, respectively. A skid shoe 38 is attached adjacent to each corner of the base 12.

Figure 9A:
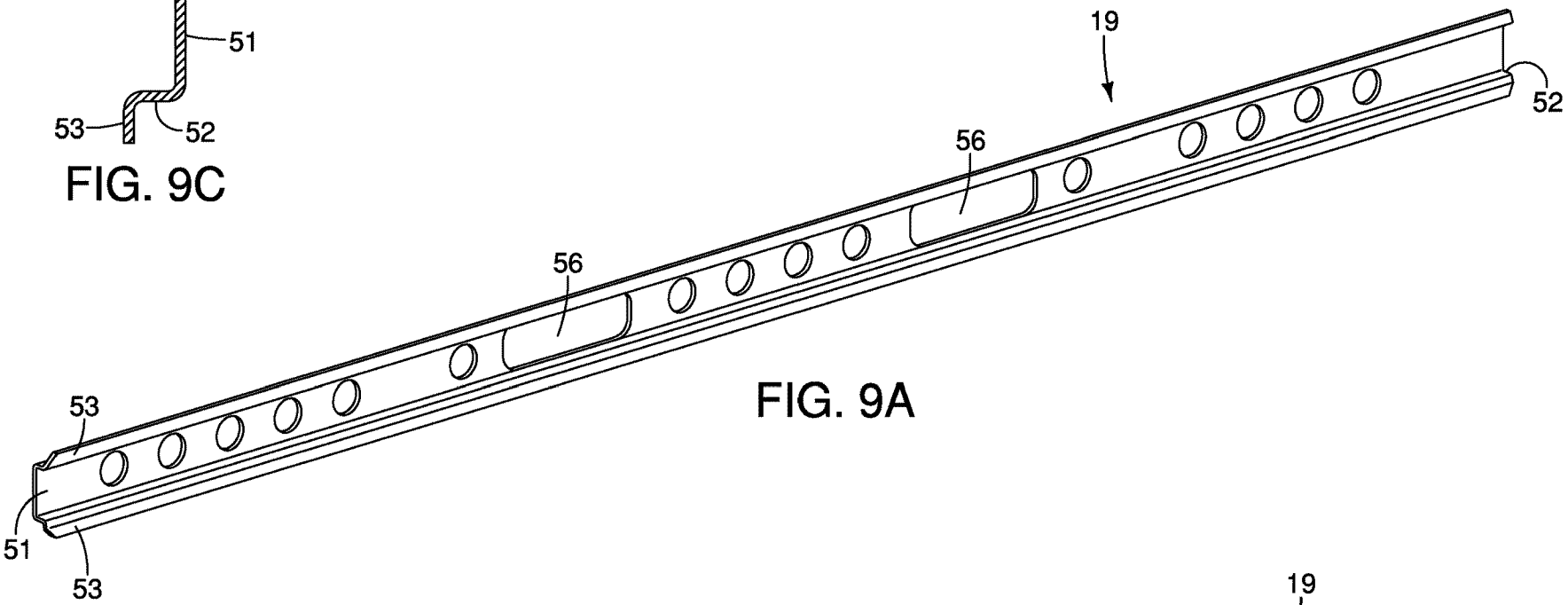
FIG. 9A is an isometric view of a structural beam.
Figure 9B:
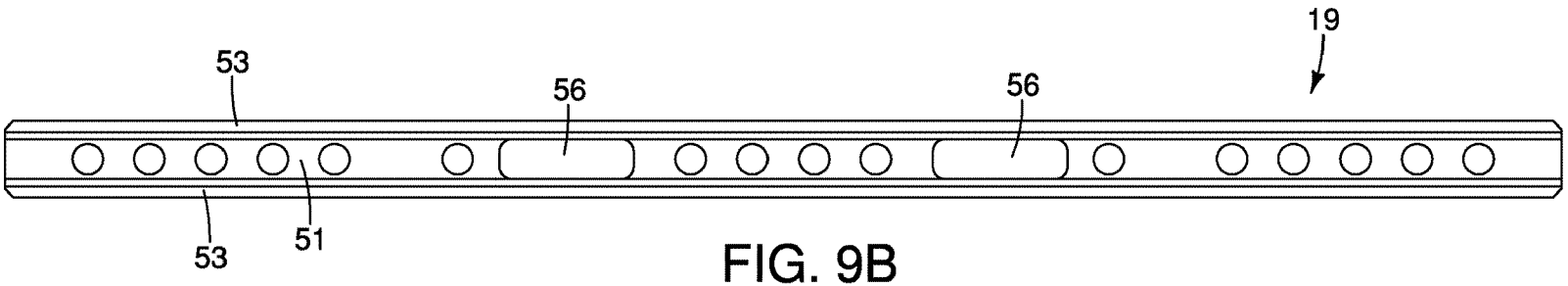
FIG. 9B is a side view of the structural beam shown in FIG. 9A.
Figure 9C:
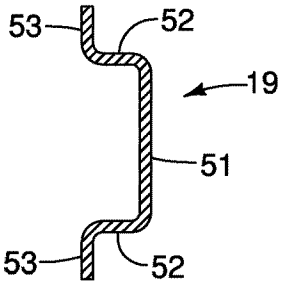
FIG. 9C is a cross-sectional view of the structural beam shown in FIG. 9A.

In an embodiment, the longitudinal beams and lateral beams of the frame 30 of the base 12 are each formed of at least one structural beam 19 having a generally C-shaped cross-sectional shape, as shown in FIGS. 9A-9C. The C-shaped structural beam 19 is roll-formed, thereby providing the structure beam 19 additional rigidity compared to a flat beam while simultaneously reducing the overall weight of the beam. It should be understood by one having ordinary skill in the art that the structural beams 19 may also be formed of other shapes, including tubular members, I-beam, flat plates, or the like. The structural beam 19 includes a longitudinal axis that is oriented in a substantially horizontal manner. The structural beam 19 includes a vertically-oriented flat central portion 51. A pair first side portions 52 extend from both the upper and lower sides of the central portion 51. The opposing first side portions 52 are integrally formed with the central portion 51, wherein a curved transition portion connects the first side portions 52 and the central portion 51. The opposing first side portions 52 are oriented substantially perpendicular relative to the central portion 51. An elongated second side portion 53 extends from each of the first side portions 52, wherein each side second side portion 53 is formed as a flat member. The second side portions 53 are integrally formed with the first side portions 52, wherein another curved transition portion connects the first and second side portions 52, 53. The second side portions 53 are oriented in a substantially perpendicular relationship relative to the adjacent first side portions 52 while being substantially parallel relative to the central portion 51. The structural beam 19 can be utilized by itself to provide structural support for the frame 30, or a pair of structural beams 19 can be fixedly attached to each other along the central portion 51 such that the first and second side portions 52, 53 of the structural beams extend laterally in opposite directions from the central portions 51. When the pair of structural beams are connected together, they provide substantially similar support as an I-beam. In an embodiment, the structural beam 19 is formed of a high-strength steel alloy, but it should be understood by one having ordinary skill in the art that the structural beam 19 can be formed of any other material sufficient to withstand the stresses and repeated collisions including, but not limited to, aluminum, steel, carbon fiber, or the like. In an embodiment, the structure beam 19 is formed using a roll-forming process to increase the overall strength of the outer structural beam 19 while also decreasing the overall weight thereof.

Figure 7:
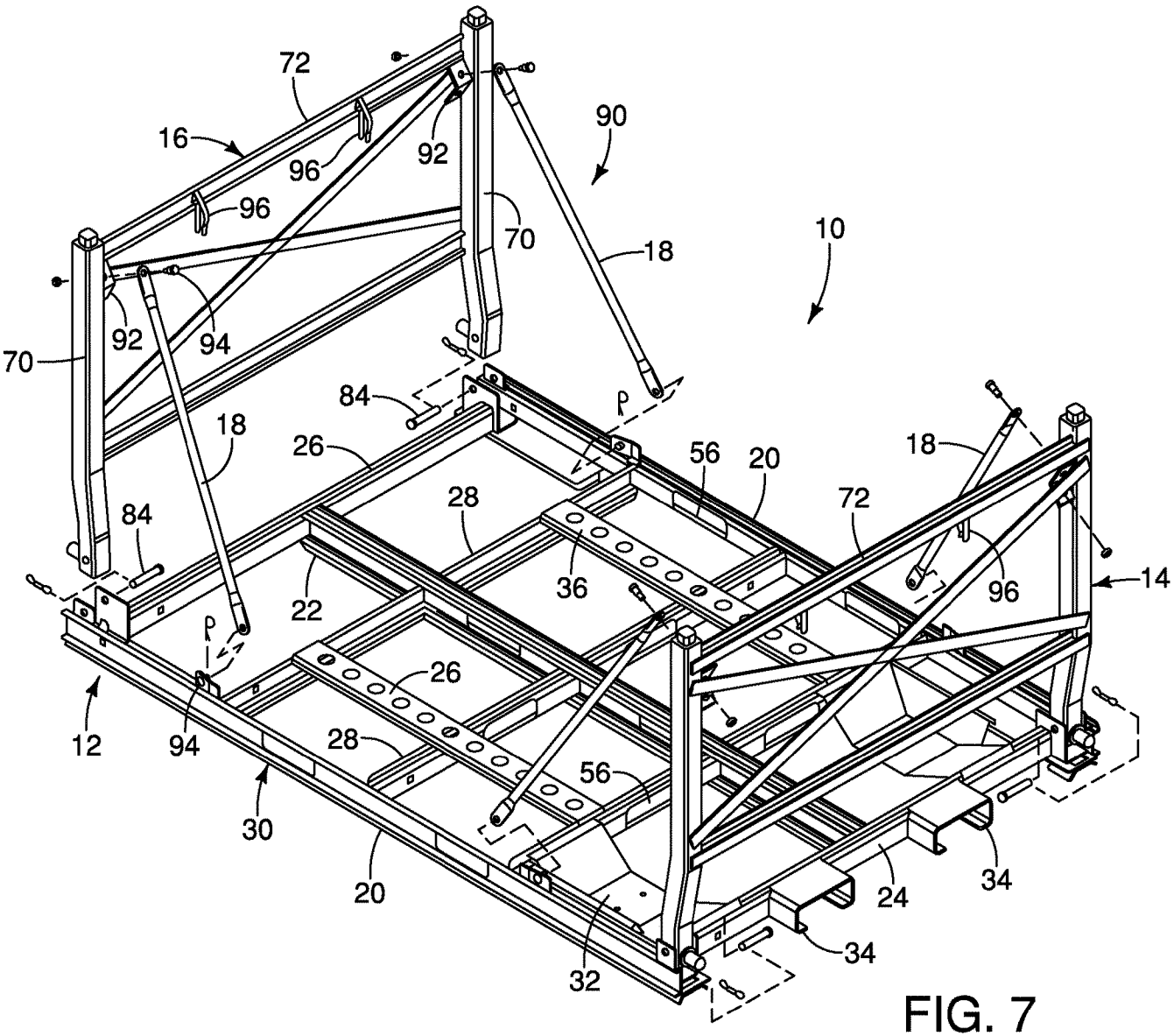
FIG. 7 is an exploded view of a foldable crate.
Figure 8:
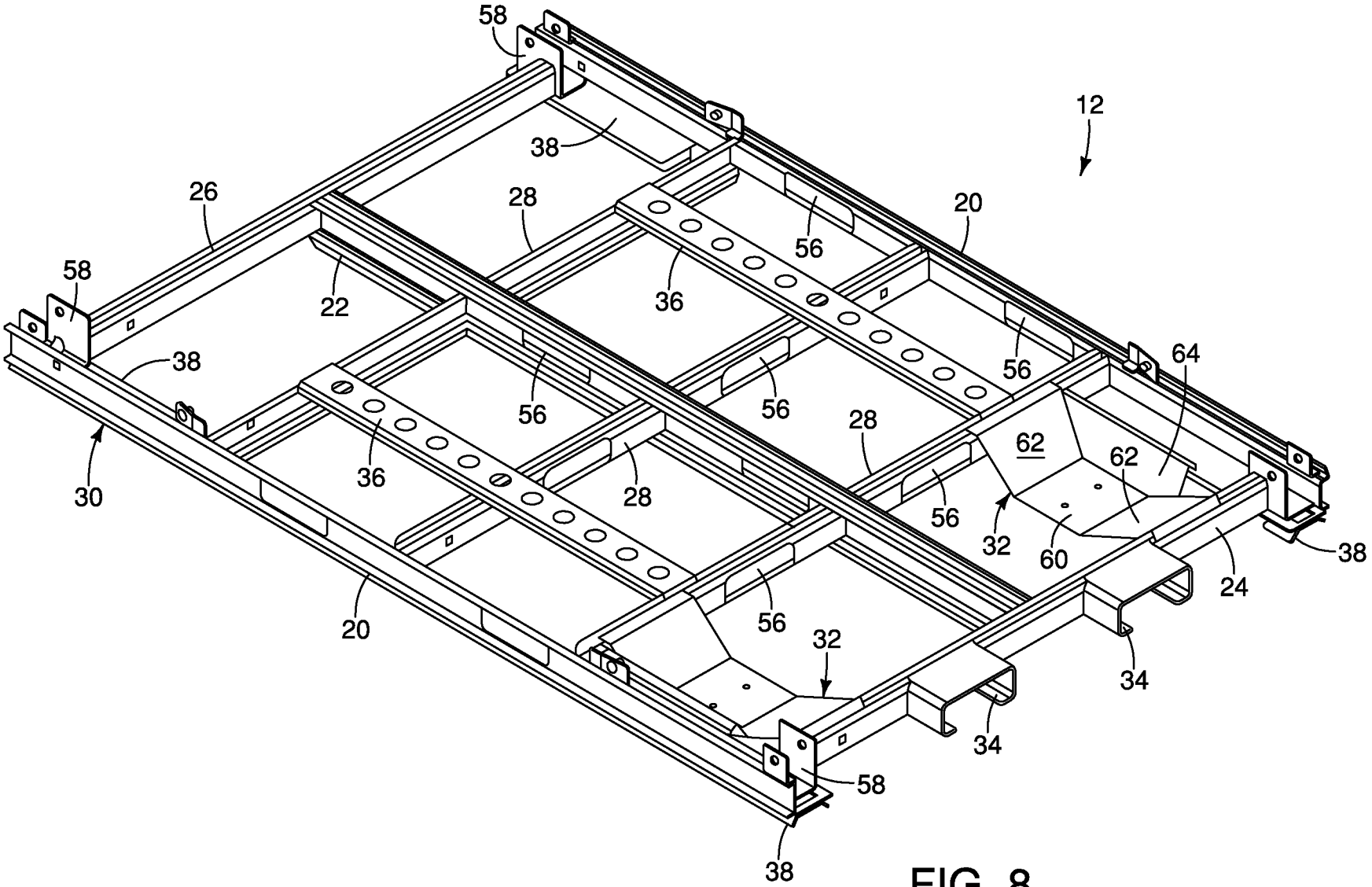
FIG. 8 is an isometric view of the base of a foldable crate.

As illustrated in FIGS. 7-8, the pair of outer longitudinal beams 20 are elongated member oriented in a substantially parallel manner. Each of the outer longitudinal beams 20 is formed of a single structural beam 19 (FIGS. 9A-9C), wherein the first and second side portions 52, 53 of each outer longitudinal beam 20 extend laterally outward in opposing directions. The outer longitudinal beams 20 are aligned in a parallel configuration relative to the longitudinal direction of the crate 10, which extends between the opposing first and second end gates 14*a*, 14*b*. The outer longitudinal beams 20 define the lateral sides of the crate 10. In some embodiments, the outer longitudinal beams 20 are formed as tubular members having a circular, rounded square, rounded hexagonal, or other cross-sectional shape.

In the embodiment illustrated in FIGS. 7-8, each of the outer longitudinal beams 20 includes a pair of spaced-apart fork holes 56 configured to receive the forks of a forklift or hand truck for easily lifting and moving the crate 10 from either lateral side thereof.

As shown in FIGS. 7-8, the frame 30 further includes a central longitudinal beam 22 that extends substantially parallel to the opposing outer longitudinal beams 20 as well as being aligned with the longitudinal axis of the crate 10. In an embodiment, the central longitudinal beam 20 is formed of a pair of structural beams 19 (FIGS. 9A-9C) in which the central portions 51 are fixedly attached to each other. The central longitudinal beam 22 includes a pair of fork holes 56 that are aligned with corresponding fork holes 56 of the outer longitudinal beams 20. The central longitudinal beam 22 is positioned centrally between the outer longitudinal beams 20, but it should be understood by one having ordinary skill in the art that more than one central longitudinal beam 22 can be disposed between the opposing outer longitudinal beams 20. The central longitudinal beam 22 is fixedly attached to both the front and rear lateral beams 24, 26 by way of a weld.

As shown in FIGS. 7-8, the frame 30 includes a front lateral beam 24 and a rear lateral beam 26, wherein the front lateral beam 24 is positioned adjacent to the forward distal end of the outer longitudinal beams 20. The front and rear lateral beams 24, 26 are oriented perpendicular to the longitudinal axis of the crate 10. The front and rear lateral beams 24, 26 are formed of a pair of structural beams 18 in which the central portions 51 are fixedly attached to each other. Both distal ends of the front and rear lateral beams 24, 26 are attached to an L-bracket 58, wherein the L-bracket 58 operatively connects the front and rear lateral beams 24, 26 to the outer longitudinal beams 20. The central longitudinal beam 22 is fixedly attached to both the front and rear lateral beams 24, 26.

In the embodiment illustrated in FIGS. 7-8, a plurality of lateral beams 28 extend between one of the outer longitudinal beams 20 and the central longitudinal beam 22 in order to provide centralized structural support to the frame 30. In an embodiment, at least one of the lateral beams 28 is formed as a single structural beam 19. In other embodiments, at least one of the lateral beams 28 is formed as a pair of structural beams 19 in which the central portions 51 are fixedly attached to each other. One end of each lateral beam 28 is welded to one of the outer longitudinal beam 20 and the opposing end of each lateral beam 28 is welded to the central longitudinal beam 22. As shown in FIG. 8, the lateral beams 28 are attached in pairs, wherein one lateral beam 28 is attached to one side of the central longitudinal beam 22 and another lateral beam 28 is attached to the other side of the central longitudinal beam 22 such that both lateral beams 28 are aligned in a parallel manner. In an embodiment, the frame 30 includes three (3) pairs of aligned lateral beams 28. In the illustrated embodiment, both of the lateral beams 28 in the two pairs nearest to the front lateral beam 24 includes a fork hole 56 configured to receive a forklift or a fork truck. The fork holes 56 have an oblong, or oval shape.

The base 12 includes a pair of spaced-apart transfer rails 36, as shown in FIG. 7. The transfer rails 36 are oriented generally parallel to the longitudinal axis of the foldable crate 10 as well as the central longitudinal beam 22. Each transfer rail 36 is aligned with one of the front wheel pans 32 so that the wheels of the riding vehicle 11 roll across the transfer rail 36 toward/away from the front wheel pans 32 during loading/unloading. The transfer rails 36 provide a smooth transition of the wheels of the riding vehicle 11 during loading and unloading by preventing the wheels from falling between each of the central lateral beams 28. The transfer rails 36 extend across the top of each of the central lateral beams 28, wherein the transfer rails 36 are fixedly attached to the central lateral beams 28.

The base 12 further includes a pair of fork guides 34 attached to the front lateral beam 24, extending longitudinally forward therefrom, as shown in FIG. 8. Each fork guide 34 surrounds a fork hole 56 formed into the front lateral beam 24. The fork guides 34 have a generally C-shaped cross-sectional shape, but it should be understood by one having ordinary skill in the art that the fork guides 34 can have a rectangular cross-sectional shape.

As shown in FIGS. 7-8, the pair of front wheel pans 32 of the base 12 extend between the front lateral beam 24 and the first central lateral beam 28 positioned immediately rearward of the front lateral beam 24. The front wheel pans 32 are located on opposite sides of the central longitudinal beam 22. Each of the front wheel pans 32 are configured to receive one of the front wheels of a riding vehicle. The front wheel pans 32 form a semi-enclosed, cradle-like structure for receiving a wheel. Each front wheel pan 32 includes a base 60, a pair of attachment walls 62, and a lateral wall 64 extending between the attachment walls 62. The base 60 is a generally flat member having a generally square shape. The pair of attachment walls 62 extends from opposing edges of the base 60 in the longitudinal direction, wherein the attachment wall 62 extending forwardly from the base 60 is attached to the front lateral beam 24 and the attachment wall 62 extending rearwardly from the base 60 is attached to the first central lateral beam 28. The attachment walls 62 extend upwardly at an angle from the base 60. The lateral wall 64 extends between the pair of attachment walls 62 to enclose the lateral side of the front wheel pan 32. The lateral wall 64 of each of the pair of front wheel pans 32 is located laterally outboard relative to the central longitudinal beam 22 such that the front wheel pans 32 are open toward the central longitudinal beam 22. Although a riding vehicle 11 may be positioned in the foldable crate 10 such that the rear wheels are located in the front wheel pans 32, the front wheel pans 32 are intended to receive the front wheels of the vehicle.

The base 12 further includes a pair of front skid shoes **38*a* and a pair of rear skid shoes 38*b* configured to protect the frame 30 from damage during transportation and relocation as well as provide structure for aiding in the stacking of multiple foldable crates 10. As shown in FIG. 8, a front skid shoe 38*a* is positioned adjacent to the forward distal end of each outer longitudinal beam 20, and a rear skid shoe 38*b* is positioned adjacent to the rear distal end of each outer longitudinal beam 20**.

Figure 10A:
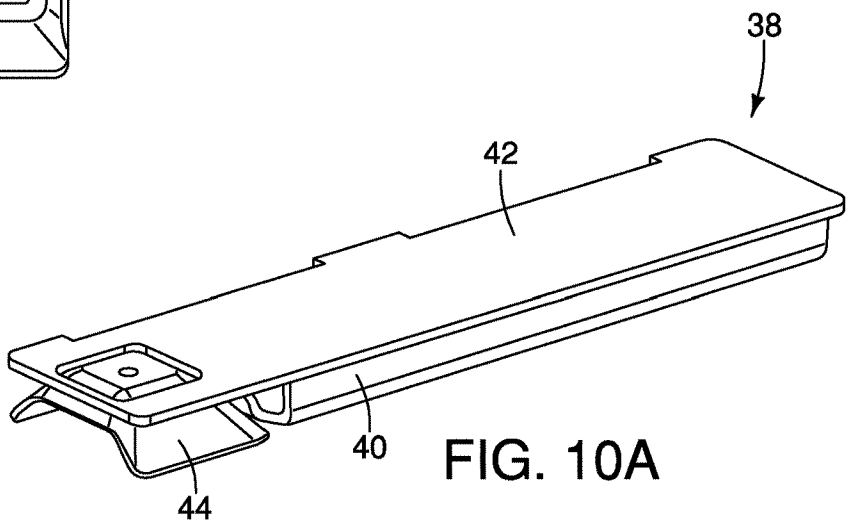
FIG. 10A is an isometric view of a skid shoe.
Figure 10B:
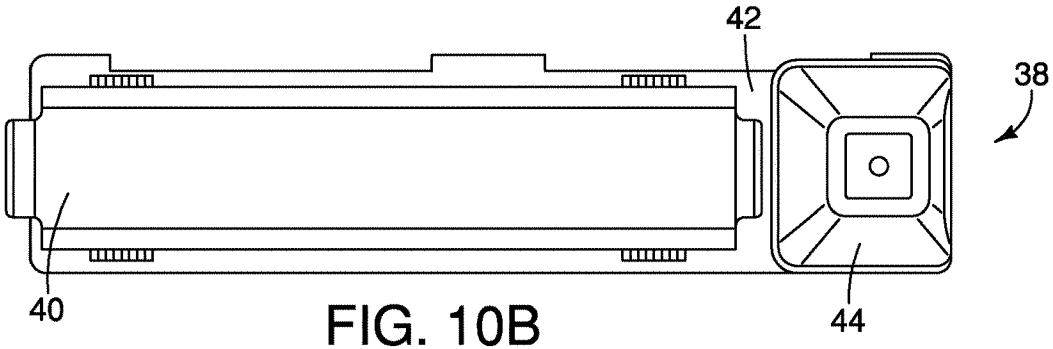
FIG. 10B is a bottom view of the skid shoe shown in FIG. 10A.
Figure 10C:
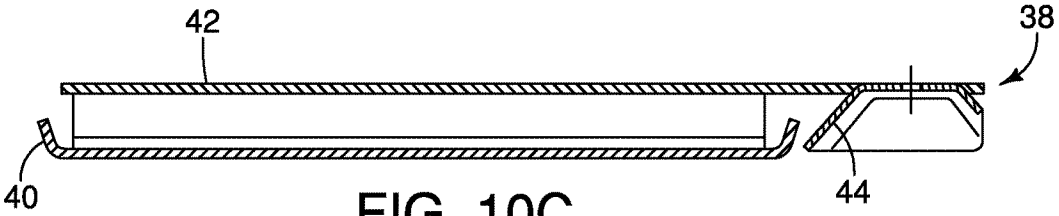
FIG. 10C is a cross-sectional view of the skid shoe shown in FIG. 10A.

Each skid shoe 38 includes a contact member 40, a base 42, and a socket 44, as shown in FIGS. 10A-10B. In an embodiment, the skid shoes 38 are fixedly attached to the frame 30. In another embodiment, the skid shoes 38 are releasably attached to the frame 30 so as to allow the skid shoes 38 to be removed for repair and replacement in case of damage or wear over time. The skid shoes 38 are configured to receive the cap 80 or the knob 86 of the end gates **14*a*, 14*b* when the foldable crates 10 are stacked while also providing a sacrificial structure below the frame 30 to help prevent the frame 30 from being damaged during loading, unloading, transport, or other similar action that may be destructive to the frame 30. The base 42 of the skid shoe 38 is a substantially flat member, and the upper surface of the base 42 is configured to be connected to the frame 30. The contact member 40 and socket 44 are attached to the lower surface of the base 42. The contact member 40 is an upwardly-directed bowl-shaped member that has a substantially flat lower surface that is oriented parallel to the base 42. The contact member 40 further includes vertical walls integrally formed with and extending from each side of the lower surface. The vertical walls of the contact member 40 are fixedly attached to the base 42, wherein the contact member forms a hollow space between the lower surface thereof and the base 42. When the foldable crate 10 is placed on the ground, the lower surface of the contact member 40 contacts the ground. The socket 44 is formed as a downwardly-directed bowl-shaped member configured to receive a cap 80 or a knob 86 that extends from an end gate 14***a*, 14*b* when the foldable crates 10 are stacked. The sidewalls of the socket 44 that extend downwardly are configured to aid in positively positioning the cap 80 or knob 86 adjacent to the base of the socket 44.

Figure 11:
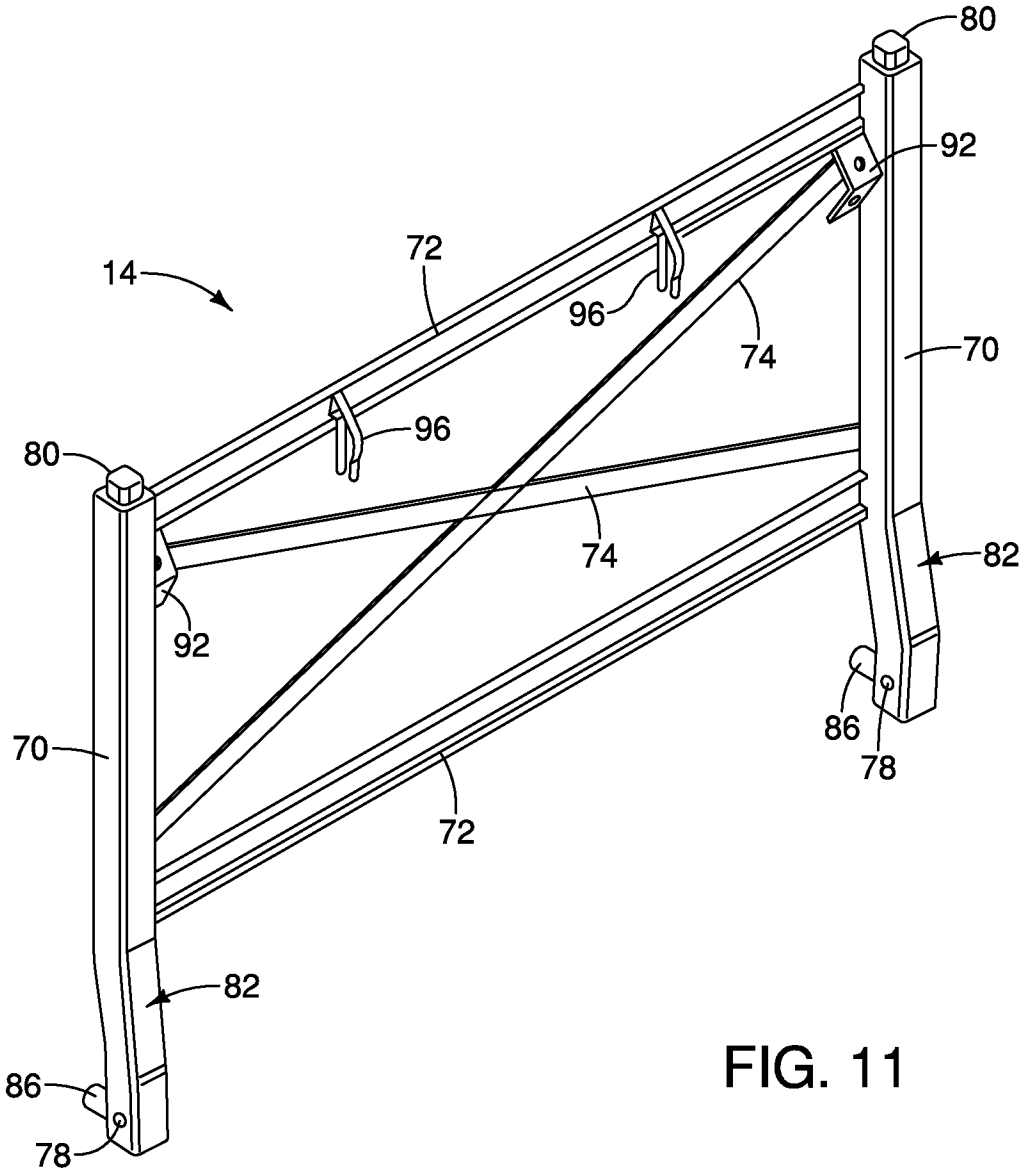
FIG. 11 is an isometric view of an end gate.

An exemplary embodiment of a gate 14 is shown in FIG. 11. Each gate 14 includes a pair of posts 70, a pair of cross beams 72, a pair of cross straps 74, and engagement mechanisms for stacking a plurality of foldable crates 10. In an embodiment, the posts 70 are elongated non-linear members. In the illustrated embodiment, each post 70 has a tubular shape and a generally square cross-section. The post 70 includes a first end and an opposing second end, wherein an aperture 78 is formed through the post 70 adjacent to the second end such that the aperture 78 extends through both opposing walls of the tubular post 70. The aperture 78 is configured to receive a rod 84 that positively and rotatably attaches the first end of each post 70 to the L-bracket 58 attached to the frame 30. In an embodiment, the rod 84 includes a pin having an aperture that receives a cotter pin that allows for easy removal of the rod 84 and disassembly of the end gate 14 from the frame 30. In other embodiments, the rod 84 can be formed as a nut-and-bolt connection, or any other mechanical connection that allows the end gate 14 to be rotatable and removable relative to the frame 30. The rod 84/aperture 78 connection allows each end gate 14 to be easily rotated relative to the frame 30.

Figure 12B:
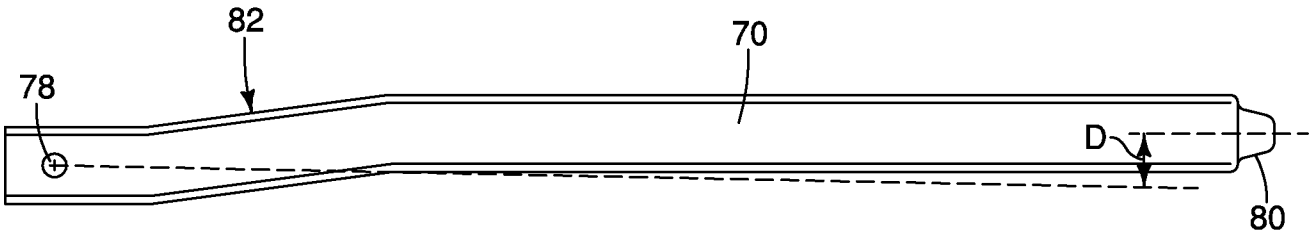
FIG. 12B is a side view of the post shown in FIG. 12A.
Figure 12A:
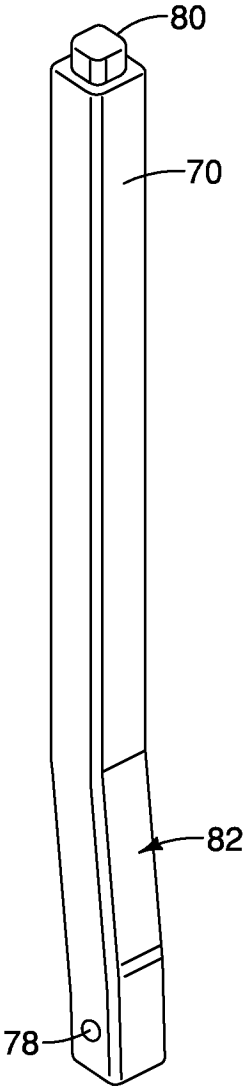
FIG. 12A is an isometric view of a post of an end gate.

The rod 84/aperture 78 connection between the post 70 of the end gate 14 and the frame 30 is located at a distance above the ground greater than half the thickness of the post 70, each post 70 includes an offset 82 formed therein, as shown in FIGS. 12*a*-12*b*. The offset 82 of the post 70 results in the longitudinal axes passing through each opposing end of the post 70 to be oriented in a parallel but non-aligned manner. The offset 82 is a transition portion of the post 70 that is located adjacent to the aperture 78. In an embodiment, the offset distance D between the centerlines of the first and second ends of the post 70 is about one inch (1"). In embodiments in which the post 70 has a linear longitudinal axis without an offset, the post 70 would be positioned at an angle relative to the ground in the second operative position in which only the second end of the post 70 opposite the aperture 78 would contact the ground. The offset 82 allows a large portion of the post 70 to lie flat on the ground during loading and unloading of a riding vehicle 11, thereby reducing or eliminating any bending stresses that would otherwise be experienced by the posts 70. It should be understood by one having ordinary skill in the art that the offset distance D is dependent upon the centerline of the aperture 78, the distance between such centerline, and the width of the tubular post 70. The offset distance D allows a large portion of the post 70 to lie flat on the ground when the gate 14 is rotated to the second operative position (or, the loading/unloading position) without the need for complex brackets or other components.

In an embodiment, the post 70 also has a second end to which one of the engagement mechanisms is attached thereto, as shown in FIGS. 12*a*-12*b*. In the illustrated embodiment, the engagement mechanism is formed as a cap 80 that is attached to the second end of the post 70. In an embodiment, the cap 80 is welded to the second end of the post 70. The cap 80 is a hollow protrusion which, when attached to the post 70, extends away from the distal end of the post 70. The cap 80 includes a flat tip having rounded edges that transition to the sidewalls thereof. The flat tip of the cap 80 is configured to be received within the socket 44 of a corresponding skid shoe 38 when a foldable crate 10 is placed atop the first and second end gates 14*a*, 14*b* when they are located in the first operative position. The rounded edges of the cap 80 engage and slide along the sidewalls of the socket 44 of the skid shoe 38 until the flat tip of the cap is in abutting contact with the base of the socket 44, whereby the stacked foldable crates 10 are positively yet removably engaged with each other. FIG. 3 illustrates a plurality of foldable crates 10 holding a riding vehicle 11, wherein the plurality of foldable crates 10 are stacked such that each of the caps 80 is received within a corresponding socket 44 of a skid shoe 38.

Another engagement mechanism of the end gate 14 is formed as a knob 86 that is attached to each post 70, as shown in FIG. 11. In an embodiment, the knob 86 is attached to the post 70 adjacent to the aperture 78 near the first end of the post 70 and extends therefrom in a substantially perpendicular manner. In an embodiment, the knob 86 is fixedly attached to the post 70. The knob 86 is formed as a substantially cylindrical member having a flat distal end thereof. The flat end of the knob 86 is configured to engage—and be received within—the socket 44 of a skid shoe 38 when a plurality of foldable crates 10 are stacked, as shown in FIG. 6. When the end gate 14 is attached to the base 12, the knobs 86 are directed away from the base 12. The knob 86 and the cap 80 are both engagement mechanisms that are configured to prevent slipping, sliding, or other relative movement of adjacent foldable crates 10 when multiple crates are stacked atop each other in either the first operative position (the transport position, FIG. 3) or the third operative position (the stacked position, FIG. 6).

In the exemplary embodiment shown in FIG. 11, the end gate 14 includes a pair of spaced-apart cross beams 72. Each of the cross-beams 72 is formed of a structural beam 19. The cross-beams 72 are oriented in a parallel manner relative to each other and perpendicular relative to the posts 70. One of the cross-beams 72 is attached to each of the posts 70 adjacent to the second end thereof, near the cap 80. The other cross-beam 72 is attached to each of the posts 70 adjacent to the offset 82. It should be understood by one having ordinary skill in the art that the end gates 14 may include any number of cross beams 72 extending between the posts 70 in order to provide structural support for the end gates 14.

Each end gate 14 further includes a pair of cross straps 74 extending between each of the posts 70, as shown in FIG. 11. The cross straps 74 are elongated, flat members oriented in an E-shaped manner, wherein both ends of the cross straps 74 are attached to one of the posts 70. The cross straps 74 provide structural support for the end gate 14 so as to prevent lateral deflection of the posts 70.

The first and second end gates 14*a*, 14*b* are selectively rotatable and connectable to the base 12 when in the first operative position by a bracing assembly 90 attached to each post 70 of the end gates 14, as shown in FIGS. 1 and 7. The bracing assembly 90 includes a brace 18, an angle bracket 92, a pair of pins 94, and at least one clip 96. Each brace 18 is formed of a cylindrical hollow tube in which both opposing ends are flattened, wherein the opposing ends are flattened in a perpendicular manner relative to the opposing flattened end. In other words, one end of the brace 18 is rolled flat to a horizontal orientation and the opposing end of the brace 18 is rolled flat to a vertical orientation. The perpendicular ends of the brace 18 allow the brace to be rotatably attached to the end gate 14 while also being releasably attachable to the base 12. Each flattened end of the brace 18 includes an aperture formed therethrough for receiving a pin, bolt, or other mechanical attachment mechanism. It should be understood by one having ordinary skill in the art that although the illustrated embodiment shows the end of the brace 18 being a member of the end gate 14 in each of the three operative positions while being releasably attachable to the base 12, the brace 18 can also be a member of the base 12 while being releasably attachable to the end gate 14. The braces 18 provide both a connection between the gates 14 and the base 12 as well as a structural connection to the base 12 in order to maintain the end gate(s) 14 in the first operative position.

As shown in FIG. 7, one end of each brace 18 is rotatably attached to an angle bracket 92 that is fixedly attached to a post 70 of an end gate 14. The angle bracket 92 is a generally L-shaped bracket, wherein one of the legs is oriented at an angle relative to the longitudinal axis of the post 70. The flattened end of the brace 18 is attached in an abutting, parallel relationship with the angle bracket 92. The angle bracket 92 is oriented such that when the brace 18 is rotated for engagement with the base 12, the mating surface of the angle bracket 92 is generally aligned with the location on the base 12 to which the brace 18 is attached. The brace 18 is rotatably attached to the angle bracket 92, thereby allowing the brace 18 to be rotated between a support position (FIG. 1) and a stored position (FIGS. 4-5). A pin 94 connects the brace 18 to the angle bracket 92, wherein the pin 94 allows the brace 18 to rotate between the support and stored positions relative to the angle bracket 92.

When an end gate 14 is positioned in the first operative position—or transport position (FIG. 1)—the free end of the brace 18 is rotated and maneuvered such that a pin 92 extending from the base 12 is received within the aperture formed in the free end of the brace 18. A cotter pin selectively secures the connection between the brace 18 and the base 12. It should be understood by one having ordinary skill in the art that any other selectively releasable attachment mechanism may be employed to connect the free end of the brace 18 to the base 12 in order to maintain the end gate 14 in the first operative position. To disconnect the brace 18 from the base 12, the cotter pin is removed from the pin 94 and the brace 18 is disengaged from the base 12 and rotated to a stored position.

When the brace 18 is disconnected from the base 12, the brace 18 is stored on-board the corresponding end gate 14, as shown in FIGS. 4-5. In the exemplary embodiment illustrated in FIG. 7, a pair of clips 96 are attached to the upper cross beam 72 of the end gate 14. Each clip 96 is configured to receive and secure the brace 18 to prevent the brace 18 from being freely hanging from the end gate 14. The clips 96 allow the brace 18 to remain attached to the end gate 14 to prevent loss of parts when the foldable crate 10 is switched between the first, second, and third operative positions.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A foldable crate comprising:

a base having a front end and a rear end, said base including:

a frame formed by a plurality of longitudinal beams and a plurality of lateral beams connected to said plurality of longitudinal beams;

a plurality of skid shoes attached to a bottom of said frame;

a first end gate rotatably attached to said front end of said base and a second end gate rotatably attached to said rear end of said base, wherein said first and second end gates being rotatable relative to said base between at least a first operative position, a second operative position and a third operative position; and wherein said first and second gates are independently rotatable relative to said base between a first operative position, a second operative position, and a third operative position;

wherein each of said first and second end gates includes a pair of posts rotatably attached to said base, said pair of posts being connected by a plurality of cross beams, and each of said posts being integrally formed as a single piece and having an offset in which opposing ends of said post are not linearly aligned.

2. The foldable crate of claim 1, wherein a knob is attached to each post adjacent to one end thereof and a cap is attached to each post adjacent to an opposing end thereof.

3. The foldable crate of claim 2, wherein said knob extends perpendicularly from said post, said knob being located adjacent to said end of said post connected to said base.

4. The foldable crate of claim 2, wherein said cap extends longitudinally from said end of said post.

5. The foldable crate of claim 2, wherein each of said skid shoes includes a socket for receiving said knob or said cap of an adjacent foldable crate.

6. The foldable crate of claim 1, wherein each of said end gates includes a pair of bracing assemblies, and each of said bracing assemblies includes a brace having one end rotatably attached to said gate and an opposing end removably connectable to said base for maintaining said gate in said first operative position.

7. The foldable crate of claim 6, wherein said bracing assemblies include a clip attached to said end gate, said clips receiving said brace for securing said brace on-board said end gate when said end gate is in positioned in said second or third operative position.

8. A foldable crate for transporting a riding vehicle comprising:

a base having a structural frame for supporting said riding vehicle, said frame having a top, a bottom, a front end, and a rear end;

a pair of front skid shoes attached to the bottom of said frame adjacent to said front end of said frame;

a pair of rear skid shoes attached to the bottom of said frame adjacent to the rear end of said frame;

a first end gate rotatably attached to said frame adjacent to said front end, said first end gate being rotatable relative to said frame between a plurality of operative positions;

a second end gate rotatably attached to said frame adjacent to said rear end, said second end gate being independently rotatable with respect to said first end gate, said second end gate being rotatable relative to said frame between a plurality of operative positions;

wherein each of said first and second end gates includes a pair of opposing posts and at least one cross beam extending between said posts; and wherein each of said posts includes a first longitudinal axis through one end of said post and a second longitudinal axis through the opposing end of said post, and each of said posts being integrally formed as a single piece and including a transition portion forming an offset, wherein said first and second longitudinal axes are parallel and not linearly aligned.

9. The foldable crate of claim 8, wherein each of said posts includes a cap extending longitudinally from an end of each of said posts and a knob extending perpendicular from each post adjacent to an opposing end of said post that is rotatably connected to said frame.

10. The foldable crate of claim 9, wherein said caps and said knobs are receivable within a portion of said front or rear skid shoe of an adjacent foldable crate in a stacked orientation.

11. The foldable crate of claim 8, wherein said frame includes a pair of wheel pans for receiving front wheels of said riding vehicle.

12. The foldable crate of claim 8, wherein said frame includes a pair of outer longitudinal beams that are spaced-apart and oriented parallel to each other, a front lateral beam extending between said outer longitudinal beams, a rear lateral beam extending between said outer longitudinal beams, and at least two central lateral beams.

13. The foldable crate of claim 12, wherein each of said outer longitudinal beams includes a pair of fork holes formed therethrough.

14. The foldable crate of claim 12, wherein said front lateral beam includes a pair of fork guides extending forwardly from said front lateral beam, and each of said fork guide surrounds a fork hole formed through said front lateral beam.

15. The foldable crate of claim 8 further comprising a bracing assembly, said bracing assembly includes a diagonal brace having a first end and an opposing second end, an angle bracket attached to one of said first or second end gates, and a clip attached to one of said first or second end gates, wherein said first end of said diagonal brace is rotatably connected to said angle bracket.

16. The foldable crate of claim 15, wherein said second end of said diagonal brace is releasably attachable to said frame for securing said first or second end gate in a transport position in which said end gate is oriented substantially perpendicular to said frame.

17. The foldable crate of claim 15, wherein said clip releasably secures said second end of said diagonal brace to said end gate.

* * * * *